United States Patent [19]

Wilson

[11] 4,417,779

[45] Nov. 29, 1983

[54] PCB-MOUNTABLE CONNECTOR FOR TERMINATING FLAT CABLE

[75] Inventor: Albert H. Wilson, Los Angeles, Calif.

[73] Assignee: Thomas & Betts Corporation, Raritan, N.J.

[21] Appl. No.: 247,897

[22] Filed: Mar. 26, 1981

[51] Int. Cl.[3] ..... H01R 13/20

[52] U.S. Cl. ..... 339/75 MP; 339/99 R

[58] Field of Search ..... 339/17 C, 75 MP, 125 R, 339/176 MF, 45, 99

[56] References Cited

U.S. PATENT DOCUMENTS

| | | | |
|---|---|---|---|
| 3,135,572 | 6/1964 | Curtis et al. | 339/198 |
| 3,519,889 | 7/1970 | Monaco | 317/100 |
| 3,633,152 | 1/1972 | Podmore | 339/91 |
| 3,680,035 | 7/1972 | Teagno | 339/59 |
| 4,009,921 | 3/1977 | Narozny | 339/99 R |
| 4,025,142 | 5/1977 | Huber et al. | 339/17 C |

FOREIGN PATENT DOCUMENTS

| | | | |
|---|---|---|---|
| 2812901 | 9/1978 | Fed. Rep. of Germany | 339/45 M |
| 2736079 | 2/1979 | Fed. Rep. of Germany . | |
| 1093491 | 12/1967 | United Kingdom | 339/45 M |

*Primary Examiner*—Howard N. Goldberg
*Assistant Examiner*—Timothy V. Eley
*Attorney, Agent, or Firm*—Robert M. Rodrick; Salvatore J. Abbruzzese

[57] ABSTRACT

Multiconductor flat cable is terminated to a printed circuit board (PCB) through an insulation-piercing connector seated in a clip member having an upwardly bowed extent engaging the PCB undersurface. A camming actuator is lever-operable both to force the connector upon the PCB and to apply anti-warpage force to the PCB undersurface.

11 Claims, 5 Drawing Figures

PCB-MOUNTABLE CONNECTOR FOR TERMINATING FLAT CABLE

FIELD OF THE INVENTION

This invention relates to electrical connectors and pertains particularly to connectors providing transition from flat multiconductor cable to printed circuit board (PCB) substrates.

BACKGROUND OF THE INVENTION

U.S. Pat. No. 4,009,921, issued to Narozny on Mar. 1, 1977 and commonly assigned with the invention herein, sets forth a connector having a housing supporting insulation-piercing electrical contact elements in laterally spaced longitudinally extending rows mutually staggered to register with the individual conductors of flat multiconductor cable. At ends distal from the insulation-piercing portions thereof, the contact elements define resilient portions situated outwardly below the housing and adapted to register with conductive strips supported on the surface of a PCB. The housing includes dependent legs insertable through openings in the PCB and engageable with the PCB undersurface both to retain the housing upon the PCB and to apply compressive force to the contact resilient portions whereby these portions are placed in low resistance engagement electrically with the PCB strips. A suitable transition from the conductors of the flat cable to the PCB strips may thus be provided over limited contact element successions, i.e., when extended contact element successions are involved, PCB warpage may serve to adversely lessen contact element and strip contact engagement uniformity. Thus, where PCB warpage occurs, higher electrical resistance is introduced as respects the longitudinally outward contact elements and strips, giving rise to less than desired connection effectiveness.

The connector of the '921 patent and various other known PCB-mountable connectors do not have sufficiently large anti-PCB warpage capabilities to meet extended contact element successions, based in a large measure upon the fact that these connectors apply force to the substrates at longitudinally opposite ends of the connector. Indeed, this characteristic is necessitated at least in part by the requirement that the intrusion of the connectors on the PCB be limited, as respects openings formed therein for connector receipt, since such openings themselves lessen substrate strength and anti-warpage character.

SUMMARY OF THE INVENTION

The present invention has as its primary object the provision of electrical connection assemblies wherein extended successions of contact elements may be afforded longitudinally of PCBs and like substrates with lessened likelihood of substrate warpage.

It is a more particular object of the invention to provide a PCB-mountable connector for terminating flat cable to PCB conductive strips having enhanced anti-warpage character without requiring expansion of openings into the PCB promotive of warpage.

A still further object of the invention is to provide an electrical connection assembly wherein anti-warpage force is positively introduced in the course of the mounting of a connector upon the PCB.

In the attainment of the foregoing and other objects, the invention provides an electrical connection arrangement inclusive of a connector and means interfittable with the connector and a substrate to both apply anti-warpage force to the substrate and to force connector contact elements into engagement electrically with the conductive strips or like contact members upon the substrate. In the particularly preferred embodiment of connection arrangement in accordance with the invention, a housing of the connector supports contact elements which have input terminals in insulation-piercing form at one side thereof and output terminals of resilient type extending outwardly of the housing base, the contact elements being in longitudinal succession in the elongate housing. A substrate, typically a PCB, has a first surface with conductive strips in individual registry with the resilient connector output terminals. Openings extend from such first substrate surface to a second opposed surface thereof at locations facing the longitudinal ends of the connector housing. The force-applying means is in the form of a clip member having continuous bowed extent engageable with the PCB second surface and arms extending from the bowed extent through the PCB openings. Actuator means engage both the clip member and the connector housing to impart thereto the forces accommodating suitable electrical connection of the contact elements and the conductive strips. The actuator means preferably comprises an operating lever rotatively mounted and including a cam eccentrically movable in the clip member arms, whereby the connector housing is urged against the PCB as the clip member bowed extent is urged against the PCB second surface.

The foregoing and other features of the invention will be further evident from the following detailed description of such preferred embodiment thereof and from the drawings wherein like reference numerals identify like parts throughout.

DESCRIPTION OF THE PREFERRED EMBODIMENT

Figure 1:
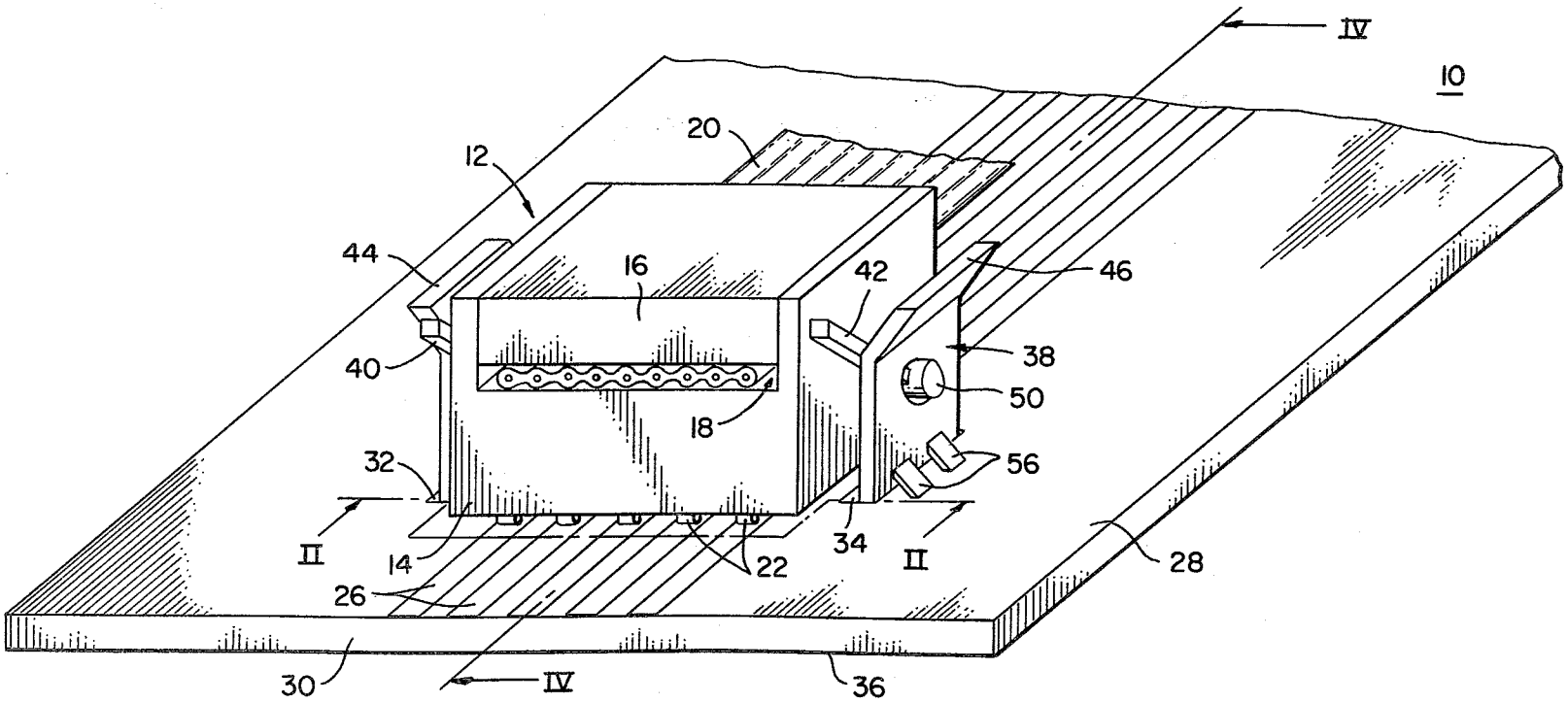
FIG. 1 is a perspective view of a connection assembly in accordance with the invention.
Figure 4:
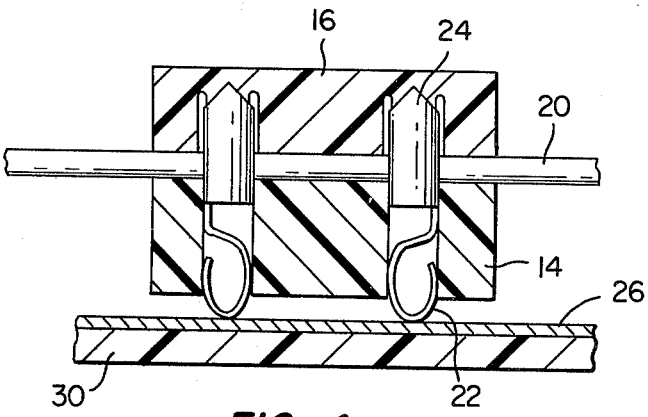
FIGS. 4 and 5 are typical partial sectional views of the connection assembly of FIG. 1 as seen along viewing lines IV—IV of FIG. 1, respectively in unlocked and locked conditions.

Referring to FIG. 1, connection assembly 10 includes a connector housing 12 having separable elongate base 14 and cover 16 which define therebetween an opening 18 adapted for receipt of multiconductor flat cable 20, shown seated in such opening. Output terminals 22 are defined by contact elements, such as are shown in FIG. 4, upper end portions 24 constituting input terminals of insulation-piercing type and individually electrically connected to conductors of cable 20. Terminals 22 extend resiliently below base 14 and are individually in registry with conductive strips or traces 26 which are located upon the upper surface 28 of substrate 30, which typically is a PCB. Openings 32 and 34 extend from PCB surface 28 to PCB undersurface 36 adjacent longitudinally opposite ends of base 14.

Connection means for locking connector housing 12 onto PCB 30 comprises a clip member 38 and actuator levers 40 and 42, respectively resident in clip member arms 44 and 46, each lever having cam means 48 and 50, extending through its corresponding clip member arm. Clip member 38 is formed of an elastically resilient material, such as, for example, beryllium copper.

Figure 2:
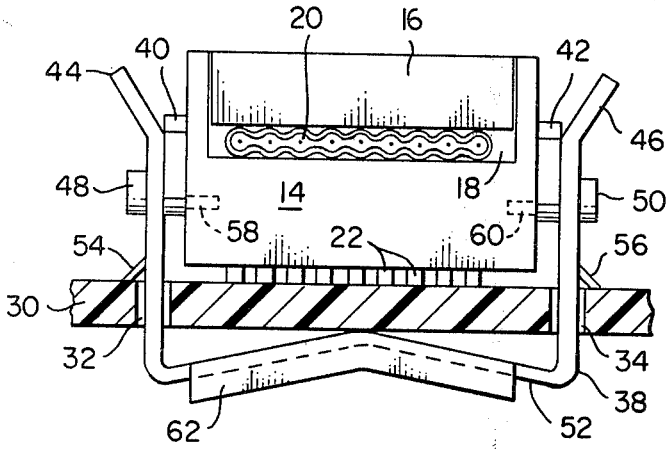
FIG. 2 is a front elevation of the FIG. 1 assembly as seen from broken plane II—II of FIG. 1.

Considering now also FIG. 2, clip member 38 will be seen further to have an upwardly bowed extent 52 extending between the lower parts of arms 44 and 46 and into engagement with the undersurface of PCB 30. Lances 54 and 56 are struck in arms 44 and 46, respectively for securing clip member 38 to PCB 30. Shafts 58 and 60, on actuator levers 40 and 42, shown in phantom in FIG. 2, seat in base 14, thus providing rotative support for the levers jointly with openings formed in the clip member arms, e.g., opening 46*a* (FIG. 3) in arm 46 seats lever cam 50.

Figure 3:
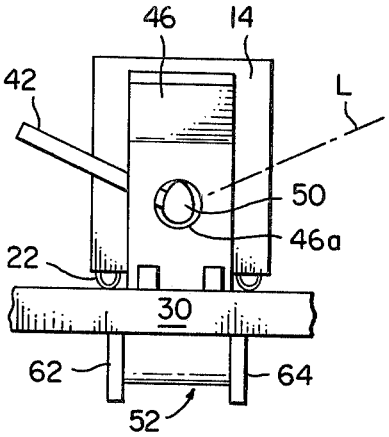
FIG. 3 is a side elevation of the assembly of FIG. 2.
Figure 5:
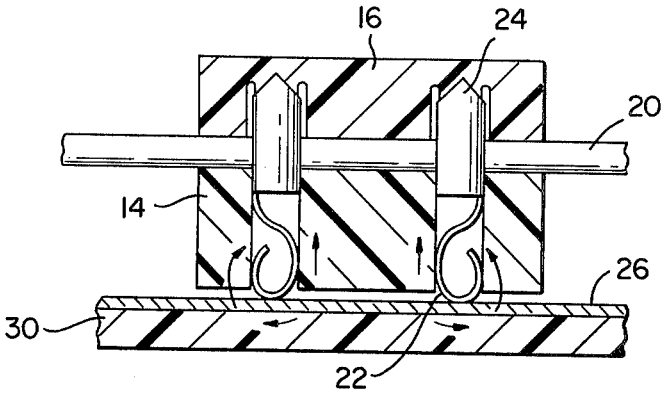

In assembling the connection arrangement above described, cable 20 is first introduced into registry with input terminals 24 with the connector cover 16 either removed from the base 14, or in openingly latched relation therewith. Cover 16 and base 14 are now disposed with the flat cable in suitable known crimping apparatus and forced into closing relation upon the cable until the input terminals pierce or displace cable insulation and engage the conductors thereof. Clip member 38 is introduced from the undersurface 36 of PCB 30 with arms 44 and 46 disposed to enter openings 32 and 34. The clip is forced through the PCB until lances 54 and 56 engage PCB upper surface 28. Levers 40 and 42 are seated in base 14 and the arms 44 and 46 are then distended sufficiently to receive and seat cams 48 and 50, levers 40 and 42 both being in unlocked or inoperative position, i.e., lever 42 being disposed to be coincident with line L in FIG. 3 and terminals 22 being in registry with the traces 26. With the parts thus assembled, the contact elements are in configuration shown in FIG. 4, i.e., output terminal portions 22 thereof are in extended O-configuration wherein they are generally fully relaxed or lightly compressed. Upon movement of the levers to operative position, i.e., upon rotation of the levers counterclockwise about 130 degrees as viewed in FIG. 3 whereby they assume the disposition shown therein for lever 42, the contact elements assume the configuration shown therefor in FIG. 5. In this configuration, output terminals 22 are compressed, moving in the course of lever operation as indicated by the arrows in FIG. 5 and into distorted O-shape. Such contact element compression is brought about by movement of base 14 into closer disposition with PCB 30 as the levers are operated. The desired movement of the base 14 is provided by means of an eccentric relationship, as shown in FIG. 3, between the cam 50 and the walls of the opening 46*a* in the clip member arm 46. The cam 50 and the opening 46*a* are configured such that when the lever 42 is moved to the position shown in FIG. 3, the cam 50 engages the upper wall of the opening 46*a*, thereby applying a downward force upon the base 14 and urging the base 14 downwardly toward the PCB 30. In the inoperative position, i.e., when lever 42 is disposed coincidently with line L, the cam 50 engages the lower wall of the opening 46*a*, thus urging the base 14 away from the PCB 30. Based on the concurrent engagement of bowed extent 52 of the clip member 38 with the undersurface 36 of the PCB and the bias such bowed extent 52 applies, the PCB is forced upwardly both to provide for uniformity of connection of output terminals 22 and strips 26 and anti-warpage force upon the substrate.

Various modifications to the particularly disclosed connection assembly will now be evident to those skilled in the art. Thus, flanges 62 and 64 may be added and clip member overall configuration may be modified as may the particular eccentric cam arrangement for effecting both locked compressed connection of output terminals and PCB traces. Also, while not shown above, suitable latching elements would be provided in mating relation on facing surfaces of cover 16 and base 14 to retain these parts in secured relation with cable 20. The described and disclosed preferred embodiment is thus intended in an illustrative and not in a limiting sense. The true spirit and scope of the invention is set forth in the following claims.

What is claimed is:

1. An electrical connection assembly comprising:

an upstanding housing;

a plurality of contact elements supported by said housing and defining connector input and output terminals;

a substrate having an upper surface supporting conductive members in facing relation to said connector output terminals and a lower surface, said substrate defining openings extending from said upper surface to said lower surface outwardly of said housing;

a clip member having arms extending through said substrate and a bowed expanse supported by said arms and engaging said substrate lower surface;

actuator means in engagement with said clip member and said housing and operable to apply a downward force by said housing upon said substrate upper surface and an upward force by said clip member upon said substrate lower surface; and lever means for operating said actuator means.

2. The connection assembly claimed in claim 1 wherein said contact elements define resilient end portions constituting said output terminals, said housing supporting said resilient end portions exteriorly of a surface thereof in facing relation to said substrate upper surface.

3. The connection assembly claimed in claim 2 wherein said contact element resilient end portions are of open O-configuration.

4. The connection assembly claimed in claim 3 wherein said contact elements define insulation-piercing end portions constituting said input terminals.

5. The connection assembly claimed in claim 4 further including a flat multiconductor cable having conductors engaged by said input terminals.

6. The connection assembly claimed in claim 1 wherein said actuator means comprises cam means rotatively supported in said arms of said clip member.

7. The connection assembly claimed in claim 6 wherein said cam means comprises a cam eccentrically disposed in each of said arms of said clip member.

8. The connection assembly claimed in claim 7 further including a flat multiconductor cable having conductors engaged by said input terminals.

9. The connection assembly claimed in claim 1 further including a flat multiconductor cable having conductors engaged by said input terminals.

10. An electrical connection assembly comprising:

(a) a connector having an elongate housing and a plurality of contact elements supported in said housing and having opposed end portions respectively constituting connector input and output terminals, said input terminals being of insulation-piercing type, said output terminals extending outwardly of a surface of said housing and being of resilient type;

(b) a substrate having a first surface defining strip contacts on a first surface thereof in facing relation to said housing surface and in registry with said connector output terminals, said substrate defining openings from said first surface to a second surface thereof opposite said first surface;

(c) a clip member having arms extending through said substrate openings and a bowed expanse supported by said arms and engaging said substrate lower surface;

(d) cam means rotatively supported in said arms of said clip member operable to move said housing relative to said substrate to thereby compress said connector output terminals upon said strip contacts; and (e) lever means for operating said cam means.

11. The connection assembly claimed in claim 10 wherein said cam means comprises a cam eccentrically disposed in each of said arms of said clip member.

* * * * *